United States Patent [19]

Boulanger

[11] 4,153,987

[45] May 15, 1979

[54] METHOD FOR ASSEMBLING KEYBOARD

[75] Inventor: Henry J. Boulanger, Cumberland, R.I.

[73] Assignee: Texas Instruments Incorporated, Dallas, Tex.

[21] Appl. No.: 768,529

[22] Filed: Feb. 14, 1977

Related U.S. Application Data

[62] Division of Ser. No. 530,889, Dec. 9, 1974, abandoned.

[51] Int. Cl.[2] ..... H01H 13/70

[52] U.S. Cl. ..... 29/622; 29/626; 200/5 A; 200/159 B

[58] Field of Search ..... 29/622, 407, 626, 464, 29/468; 156/64, 182, 212, 230, 234, 290, 292; 200/5 R, 5 A, 159 B

[56] References Cited

U.S. PATENT DOCUMENTS

| | | | |
|---|---|---|---|
| 3,722,086 | 3/1973 | Wikkerink | 29/622 |
| 3,749,859 | 7/1973 | Webb et al. | 200/5 A X |
| 3,769,869 | 11/1973 | Nelson, Jr. | 200/159 B X |
| 3,806,673 | 4/1974 | Boulanger | 200/159 B X |
| 3,859,723 | 1/1975 | Hamer et al. | 29/626 |
| 3,860,771 | 1/1975 | Lynn et al. | 200/5 A |
| 3,886,012 | 5/1975 | Slater | 200/5 A X |
| 3,886,335 | 5/1975 | Hendricks | 200/1 R |
| 3,886,341 | 5/1975 | Forrest | 200/328 |
| 4,033,030 | 7/1977 | Robinson et al. | 29/622 |

*Primary Examiner*—C. W. Lanham
*Assistant Examiner*—Gene P. Crosby
*Attorney, Agent, or Firm*—John A. Haug; James P. McAndrews

[57] ABSTRACT

A method is shown for assembling a calculator keyboard which comprises a plurality of switches on a substrate board where each switch comprises first and second contacts spaced from each other on one side of the board and an electrically conductive actuating element such as a domed metal disk overying the first and second contacts. The method for assembling the keyboard involves arranging a plurality of the disks in position relative to one another (as on a fixture) corresponding to their desired locations on the substrate board and then adhering a sheet of flexible, insulative material to the outer faces of the disks. The sheet with the elements adhered thereto is then transferred to the substrate board and is adhered to one face of the substrate board so that each of the disks is properly positioned relative to its respective contacts and so that the disks are sealed to the substrate board.

2 Claims, 6 Drawing Figures

METHOD FOR ASSEMBLING KEYBOARD

This is a division of application Ser. No. 530,889, filed 12-9-74 now abandoned.

BACKGROUND OF THE INVENTION

This invention relates to manually operable pushbutton keyboard systems for electronic pocket calculators, for pushbutton telephones, or for other electrical or electronic appliances, and it is more particularly concerned with such a keyboard which utilizes dished or domed disks as switch actuating elements in momentary single-pole, single-throw (SPST) switches on the keyboard.

Domed disks have been successfully utilized as switch actuating elements in pushbutton keyboard systems in the past. They offer several advantages as they require fewer parts than other types of SPST switches, are readily manufactured, and are easy to assemble. Furthermore, upon depressing the disk to an overcentered actuated position, they provide a tactile feel and an audible snapping sound signalling the operator that the switch has been properly actuated. In prior art keyboards, such as illustrated in the following coassigned U.S. Pat. Nos. 3,684,842, 3,806,673 and 3,808,384, the disks are shown to be retained at their respective switch locations by means of a relatively thick (i.e., having a thickness of about the height of the disk) retainer plate having an array of openings therein for reception of the disks as they are supported above their respective contacts, and by a sheet of insulative material, such as polyethyleneterephthalate, commercially available under the trade designation MYLAR from the E. I. duPont de Nemours and Company. As illustrated in FIG. 4 of the previously mentioned U.S. Pat. No. 3,806,673, this MYLAR sheet has in the past been adhesively bonded to the top face of the retainer plate, but it was free of the outer convex faces of the disks. It has been found that if the MYLAR sheet was adhesively bonded to the outer faces of the disks and to the retainer plate, the MYLAR sheet would grip the outer faces of the disks and hold them in a semi-actuated position which, under some circumstances, would prevent the disks from making contact with their respective contacts when manually depressed by the operator.

SUMMARY OF THE INVENTION

Among the several objects of this invention may be noted the provision of a keyboard system, such as above described, in which the requirement of a retainer plate is eliminated; the provision of such a keyboard system in which the disks are effectively sealed to the substrate board thereby to avoid contamination of the electrical contact surfaces of the keyboard system; the provision of such a keyboard which utilizes less material and requires less labor for assembly; the provision of such a keyboard system which is of low cost, which is readily installed in an electronic pocket calculator or the like, and which is reliable in operation; and the provision of a method of assembling a keyboard system in which the switch actuating elements (e.g., disks) may be positioned on the substrate board and secured thereto in a single step. Other objects and features of this invention will be in part apparent and in part pointed out hereinafter.

Briefly, a keyboard system of this invention comprises an electrically insulative substrate board and a plurality of switches on one face of the board. Each of these switches includes a first contact and a second contact spaced from the first contact of one surface of the board and an actuating element of an electrically conductive material overlying the first and second contacts at each switch location. Each element is resiliently deformable from a first position in which its outer margin is in electrical contact with its respective first contact and in which it is spaced from its respective second contact and a second or actuated position in which the element remains in contact with its first contact and in which one point on the element contacts its second contact thereby to complete a circuit between its first and second contacts. The keyboard system further comprises means at a margin of the board for interconnection of other electronic components, conductor paths connecting the first and second contacts at each switch location to the interconnecting means, and a sheet of flexible insulative material bonded to the one face of the board and to the outer faces of the elements for securing the elements in position relative to their respective first and second contacts, for permitting the elements to be deformed to their actuated positions, and for sealing the actuating elements to the one face of the board.

The method of this invention comprises arranging a plurality of actuating elements into position relative to one another corresponding to the desired locations of the elements on the substrate board. A sheet of flexible, insulative material is adhered to the outer faces of the elements. The sheet with the elements adhered thereto is then transferred to the substrate board and is adhered to one face of the board so as to adhere each of the elements to the board in proper position relative to its respective contacts, and to seal the elements to the board.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
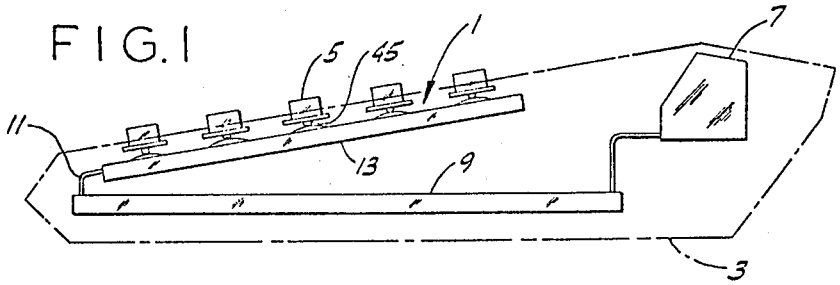
FIG. 1 is a side elevational view of a pocket electronic calculator (shown in phantom) utilizing a keyboard system of this invention.

Referring now to the drawings, a keyboard system of this invention generally indicated at 1 is shown installed in a pocket electronic calculator 3. The calculator is shown to have a motherboard 9 on which various solid state and integrated circuit logic components (not shown) are mounted, and a lightemitting diode (LED) display module 7. The keyboard is operated by manual pushbuttons 5 and is connected to the motherhood by umbilical wires 11.

More particularly, keyboard system 1 has an electrically insulative substrate board 13 of laminated phenolic or other suitable synthetic resin material. A plurality of single-pole, single-throw (SPST) momentary switches 15 are provided on one face constituting the front face of board 13. Each of these switches comprises face of board 13. Each of these switches comprises a first or outer contact 17 and a second or inner contact 19 and an actuating element 21 of a resilient, electrically conductive material, such as stainless steel or phosphor bronze, overlying the inner and outer contacts. Elements 21 are shown to be domed circular disks having an inner concave face and an outer convex face. These disks are resiliently deformable from a first or initial convex position (see FIG. 4) in which the outer margin of the disk is in electrical contact with the outer contact 17 and in which it is spaced from the inner or second contact 19 and a second or actuated position (see FIG. 5) in which the outer margin of the disk remains in contact with the outer contact and in which one point 23 on the disks contacts the inner contact thereby to complete a circuit between the inner and outer contacts. Upon being released, the disks will snap back to their initial convex position.

The keyboard further includes terminals 25 at one margin of board 13 for interconnection of switches 15 to motherboard 5 via umbilical wires 11. Holes 27 through board 13 (the inside surfaces of these holes having a layer of metal thereon) and conductor paths 29 on the back face of board 13 electrically connect the inner and outer contacts 17 and 19, respectively, at each switch location to terminals 25. A sheet 31 of flexible insulative material, such as polyethylene terephthalate, commercially available under the trade designation MYLAR from the E. I. duPont de Nemours and Company, is bonded to the board and to the outer convex faces of disks 21 for securing the disks in position on the board relative to their respective inner and outer contacts, for permitting the disks to be resiliently deformed to their overcentered actuated positions, and for sealing the disks to the board so as to prevent contaminants from lodging between the disks and their respective inner contacts 19 which may deleteriously affect operation of the keyboard. Preferably, one face of sheet 31 is coated with a pressure-sensitive adhesive (not shown) for being adhesively bonded to the board and to the disks and thus the sheet constitutes and is referred to as a sheet of pressure-sensitive, insulating tape.

Figure 2:
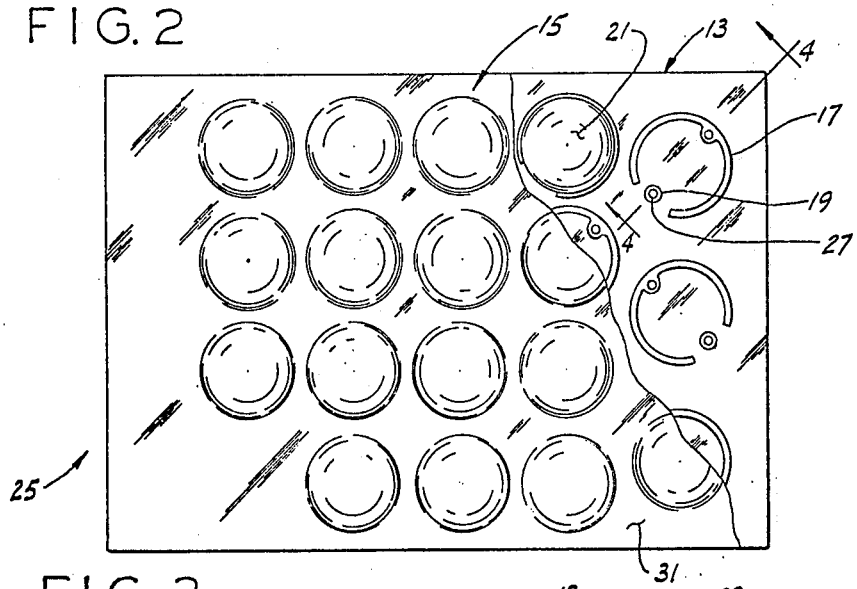
FIG. 2 is an enlarged plan view of a keyboard of this invention with parts broken away for clarity.
Figure 3:
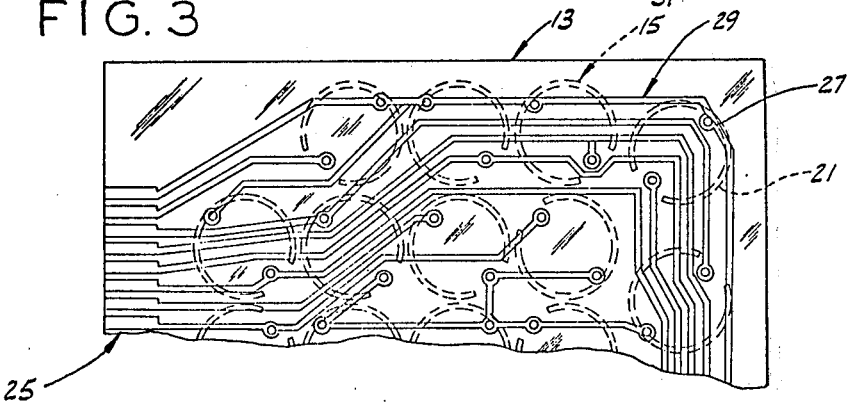
FIG. 3 is a partial bottom view of the keyboard.

Conductor paths 29 and contacts 17 and 19 are preferably formed on board 13 by a so-called subtractive method in which the insulative board 13 having a layer of copper of about two ounces per square foot on each face thereof has a requisite number of holes 27 formed herein, as by drilling, and another layer of copper of about one ounce per square foot is added to both surfaces of the board, as by electrolytic plating, thereby to make the inside surfaces of holes 27 conductive. A mask is then placed over the board and the copper is chemically etched away from the board except in a desired configuration, such as shown in FIGS. 2 and 3. A thin layer of oxidation-resistant metal, such as gold, may then be deposited on the conductor paths. It will be understood, however, that conductor paths 29 and contacts 17 and 19 may be formed by any suitable method, such as by additive electroless plating processes or the like.

Figure 4:
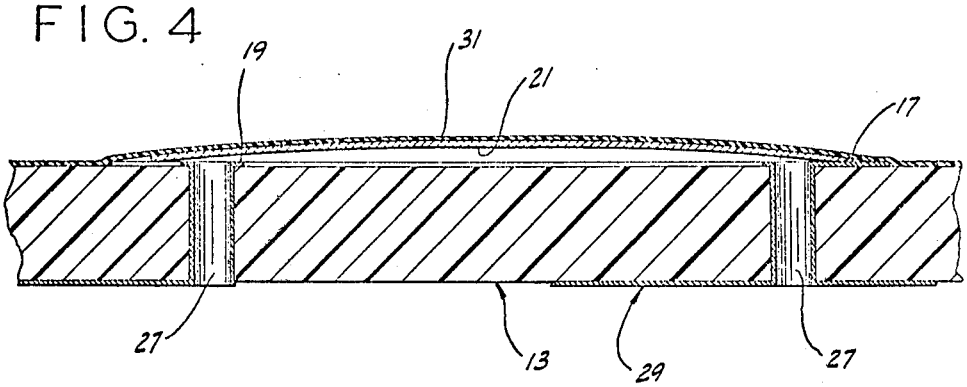
FIG. 4 is a partial cross sectional view on an enlarged scale of a portion of the keyboard of this invention illustrating a switch actuating disk in its initial position supported on an outer electrical contact and clear of an inner contact.
Figure 5:
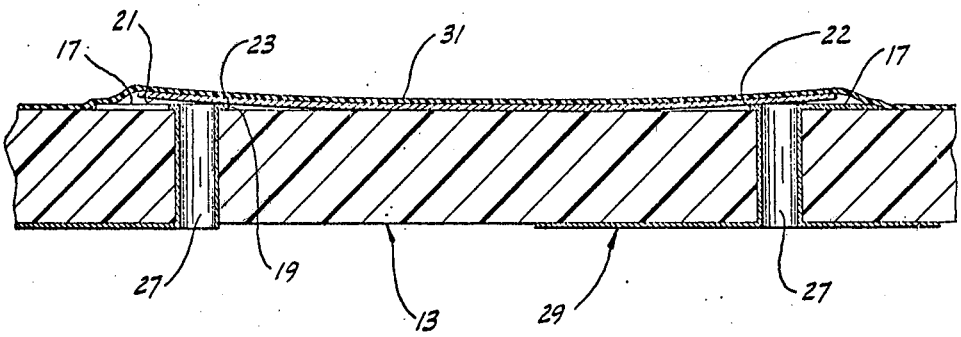
FIG. 5 is a view similar to FIG. 4 illustrating the disk in its overcentered actuated position.

As best shown in FIG. 4, the outer margin of each disk 21 is substantially coplanar with the surface of board 13, the disk being set off from the surface of the board only by the thickness of contact 17 (the thickness of which is shown exaggerated in the drawings). For example, the thickness of the outer contact may be about 0.004 inch (0.10 m.m.). The outer contact 19 is shown to be an open ring having a mean diameter equal to the diameter of disk 21 so that the outer margin of the disk rests on the outer contact. Inner contact 19 is shown to be a generally circular spot of metal on board 13 within the outer contact. This inner contact is shown to have a hole 27 therethrough and is substantially larger in diameter than the hole. More particularly, the inner contact is shown adjacent, but spaced from, the outer contact and is preferably positioned intermediate the ends of the open ring constituting the outer contact. With the disk in its initial convex position and with its outer margin in engagement with outer contact 17, the inner concave surface of the disk is spaced from (and electrically insulated from) inner contact 19 (see FIG. 4). Upon deforming the disk to its overcentered actuated position (see FIG. 5), it will be noted that the center of the disk is essentially level with, but spaced slightly below, the tops of contacts 17 and 19. The outer margin of the disk remains in contact at 22 with the inner portion of the outer contact 17, but point 23 on the inner face of the disk engages the inner contact 19 and thus completes a circuit between contacts 17 and 19. It will be understood that the location of the inner contact may be anywhere within the outer contact so that the inner contact is engageable by the inner concave face of the disk as the disk is moved over center to its actuated position. It will be further noted that the outer margin of the disk remains substantially coplanar with the one surface of substrate board 13, even as the disks are moved to their overcentered actuated positions, so as to permit sheet 31 to fit smoothly over the outer margins of the disks and the face of the board immediately adjacent the outer margins of the disks. It will also be understood that the inner and outer contacts and the location and placement of conductor paths 29 may have a variety of configurations. For example, the inner and outer contacts 17 and 19 may be substantially thinner then shown in the drawing so that with the disk in its actuated position, the disk is essentially flat (i.e., the center of the disk is at the same level as the outer margin of the disk).

Figure 6:
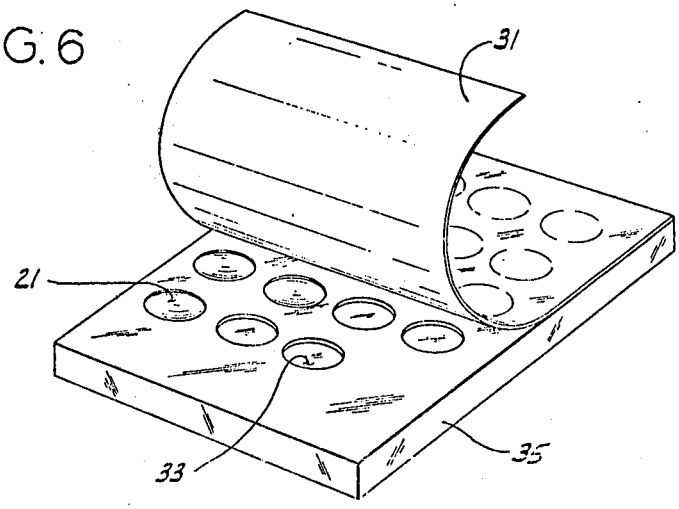
FIG. 6 is a perspective view illustrating the method of this invention of assembling a keyboard in which the actuating disks are positioned in recesses in a fixture and a sheet of pressure-sensitive, insulative tape is adhered to the outer faces of the disks for transfer of the disks to the substrate of the keyboard.

In accordance with the method of this invention, a plurality of disks 21 are arranged in recesses 33 in a fixture 35 (see FIG. 6). Recesses 33 are positioned relative to one another to correspond to the desired arrangement of disks 21 on substrate board 13, there being one recess 33 for each switch 15 on the keyboard. The disks are arranged in the recesses with their convex faces facing up. The recesses are of such depth that the domed disks extend above the level of the fixture. A length of pressure-sensitive, insulative tape constituting sheet 31 is then adhered to the outer faces of the disks. Fixture 35 may be of a nonstick, material, such as tetrafluoroethylene (TFE), commercially available under the trademark TEFLON from E. I. duPont de Nemours and Company, so that the pressure-sensitive coating on the tape does not stick to the fixture. It will be understood that the disks may automatically be arranged on the fixture in recesses 33 with their convex faces up by known vibratory feed equipment.

After adhering disks 21 to sheet 31, the sheet and the disks are transferred to substrate board 13. The disks in one of the transverse rows on sheet 31 are then placed on their respective outer contacts 17. This automatically aligns or indexes the other disks on the tape with their respective contacts. The tape is then adhered to the face of the substrate thus simultaneously positioning the disks on their contacts, securing the disks in position on the board, and sealing the disks to the board. It will be understood that other indexing means, such as alignment marks or pins, may be provided on the substrate board and on the sheet 31 for aligning it together with the disks adhered thereto relative to contacts 17 on the board.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of assembling a keyboard system for an electronic pocket calculator or the like, the keyboard system having an insulative substrate board and a plurality of switches arranged on one face of the board, each switch comprising a pair of spaced contacts on the board and a resilient deformable actuating element positioned to be selectively deformed to engage both of its respective contacts to thus complete a circuit therebetween, said method comprising the steps of:

arranging a plurality of said actuating elements at a first station in position relative to one another corresponding to the desired locations of said elements on said substrate board;

adhering a sheet of flexible insulative material to the outer faces of said elements at said first station for securing the elements in said position relative to each other;

transferring the sheet with the elements adhered to the sheet and retained in position relative to each other by the flexible sheet to said substrate board at a second station; and adhering said flexible sheet to said one face of said substrate board at said second station so as to secure each of said elements to said board in proper position relative to its respective contacts to be adapted to be selectively deformed for completing a circuit between the contacts and to seal the elements to the board.

2. The method of claim 1 wherein said actuating elements are domed disks having a convex outer face and a concave inner face, and wherein said method further comprises arranging said disks relative to one another with their concave inner faces down and adhering said sheet to their convex outer faces.

* * * * *